United States Patent [19]

Okada

[11] Patent Number: 4,772,023

[45] Date of Patent: Sep. 20, 1988

[54] SLOT MACHINE

[75] Inventor: Kazuo Okada, Tokyo, Japan

[73] Assignee: Kabushiki Kaisha Universal, Tochigi, Japan

[21] Appl. No.: 26,440

[22] Filed: Mar. 16, 1987

[30] Foreign Application Priority Data

Mar. 14, 1986 [JP] Japan ..... 61-56697

[51] Int. Cl.[4] ..... A63F 7/00

[52] U.S. Cl. ..... 273/143 R

[58] Field of Search ..... 273/143 R, 138 A, 1 E; 364/410–412, 717

[56] References Cited

U.S. PATENT DOCUMENTS 4,448,419 5/1984 Telnaes ..... 273/143 R 4,492,379 1/1985 Okada ..... 273/143 R

*Primary Examiner*—MaryAnn Lastova

*Attorney, Agent, or Firm*—Young & Thompson

[57] ABSTRACT

A slot machine having X series of symbols arranged side by side which selects a combination of symbols on a winning line. For the selection of a combination of symbols, a random number is sampled from a series of random numbers the number of which is $2^n$ and is referred to symbol tables associated with each symbol series wherein are coded data on symbols of which the number is equal to the Xth root of $2^n$. A combination of symbols is thus selected with the same probability as for sampling a random number.

2 Claims, 4 Drawing Sheets

SLOT MACHINE

BACKGROUND OF THE INVENTION

The present invention relates to a slot machine which preselects a prize-winning combination of symbols based on a random-sampled number and controls a plurality of lengthwise movable series of symbols to stop so as to provide the preselected prize-winning combination of symbols on a winning line.

Slot machines have heretofore been controlled to pay out coins with a definite pay-out ratio being maintained at a predetermined level, and have been adapted to preselect an occurrence of a prize-winning combination of symbols and the pay-out value of the prize-winning combination of symbols, both based on a random-sampled number from a predetermined series of random numbers, so as to avoid prize-winning combinations of symbols occurring with different frequencies according to the skill of players.

In such the slot machine having, for example, three symbols reels, a random-sampled number is referred to values of a probability table so as to predetermined the pay-out value of a combination of symbols to be selected, according to which an appropriate combination of symbols is selected with reference to symbol tables associated with the respective reels. Alternatively, each symbol on each reel corresponds to a single random number so as to be unconditionally specified by sampling one of a series of random numbers.

In most slot machines wherein a symbol to be selected on a winning line is determined by sampling a random number for each reel, there is a difference in number between the series of random numbers and the symbols on the reels. A series of random numbers generated from, for example, a 15-bit register is 32,768 in number in the binary system of notation, while there are, if each reel has 22 symbols, 10,648 possible combinations of symbols to be selected. Therefore, there will be a difference in probability between the occurrence of any one of the possible combinations of symbols and the sampling of a specific random number corresponding to the combination of symbols to be produced. As a result, even if a random number can be sampled with uniform probability, the selection of a combination of symbols will have a weight probability which is undesirable in such games.

This weighted probability can be theoretically eliminated by the provision of random numbers of the same number as the possible combinations of symbols. However, since an n-bit register is ordinarily used in a random number generator, the random number generator is very complicated in circuitry and the generation of random numbers would be very difficult in the case of generating the same number of random numbers as the number of possible combinations of symbols on the reels.

OBJECTS OF THE INVENTION

It is, therfore, an object of the present invention to provide a slot machine wherein a random number can be sampled with the same probability as that with which a possible combination of symbols occurs.

It is another object of the present invention to provide a slot machine wherein a random number generator adapted to achieve this object is not of substantially greater complexity of construction than conventional slot machines.

SUMMARY OF THE INVENTION

According to the present invention, a random number Rs is sampled from the number $2^n$ of random numbers with a probability of $\frac{1}{2}^n$ and is referred to a symbol table in association with each of X series of movable symbols so as to specify a symbol on each series of movable symbols. In each symbol table, since there are stored data of symbols on the number Y which is the Xth root of $2^n$, the probability with which a combination of symbols is specified with reference to the symbol table is the same as that of the sampling of a random number Rs.

BRIEF DESCRIPTION OF THE DRAWINGS

These and other objects and features of the present invention will become apparent from the following description taken in conjunction with preferred embodiments with reference to the accompanying drawings, in which.

DETAILED DESCRIPTION OF THE INVENTION

Because slot machines are well known, the present description will be directed in particular to elements forming part of, or cooperating more directly with, the present invention, the slot machine structure not specifically shown or described herein being understood to be selectable from those known in the prior art.

Figure 1:
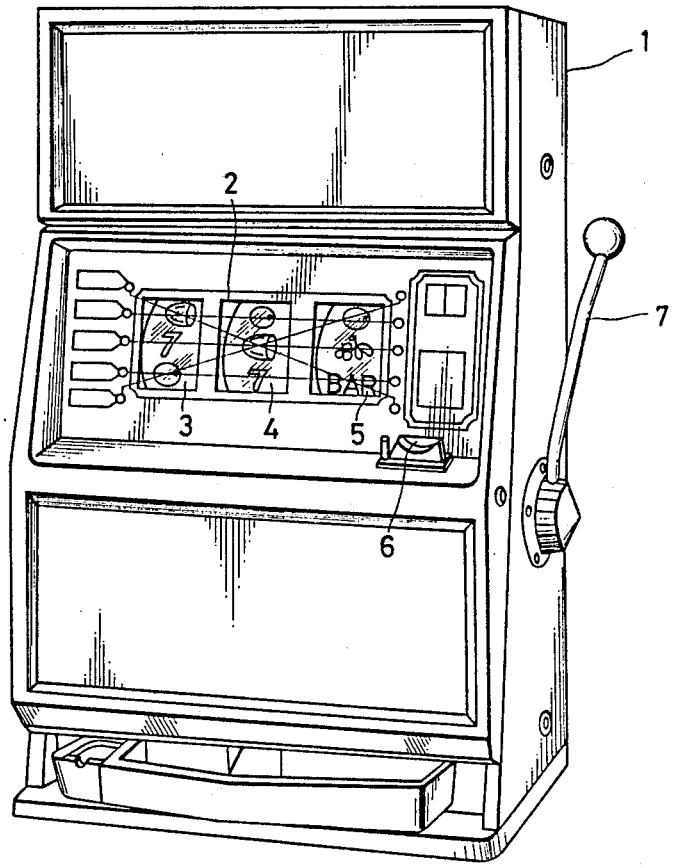
FIG. 1 is a perspective view showing one example of a slot machine embodying the present invention.

Referring now to FIG. 1 showing the outer appearance of a three-reel type of slot machine embodying the present invention, in the front panel of a housing 1 of the slot machine are displayed windows 2 through which symbols disposed on the outer peripheries of first to third reels 3 to 5 arranged side by side in the housing 1 can be viewed, three symbols in each display window 3, 4, 5. Each display window is covered with a transparent glass. There are five winning lines across the display windows 3 to 5, namely, three horizontal winning lines and two oblique winning lines. When a combination of a set of symbols on a winning line coincides with any one of a plurality of predetermined prize-winning combinations of symbols, prizes or dividends are given according to the prize-winning combination on the winning line. The number of winning lines played depends on the number of coins inserted into the slot machine through a coin slot 6. For simplicity, the following description will be given for the case in which the central horizontal line is played.

The slot machine is played by the insertion of coins into the coin slot 6 and pulling a start level 7. When the player pulls the start level 7, the respective reels 3 to 5 start into rotation simultaneously. After each reel 3, 4, 5 reaches a constant speed of rotation, each reel 3, 4, 5 is stopped. When each reel 3, 4, 5 is stopped, the displayed symbols on each reel 3 to 5 may be viewed through the respective window 2. When all reels 3 to 5 stop, a windecision is made based on the combination of symbols stopping on the winning line that was played. In this embodiment, there are provided as winning dividends a big hit awarding 15 coins and a bonus game, a middle hit awarding 15 coins, and a small hit awarding two to five coins.

Figure 2:
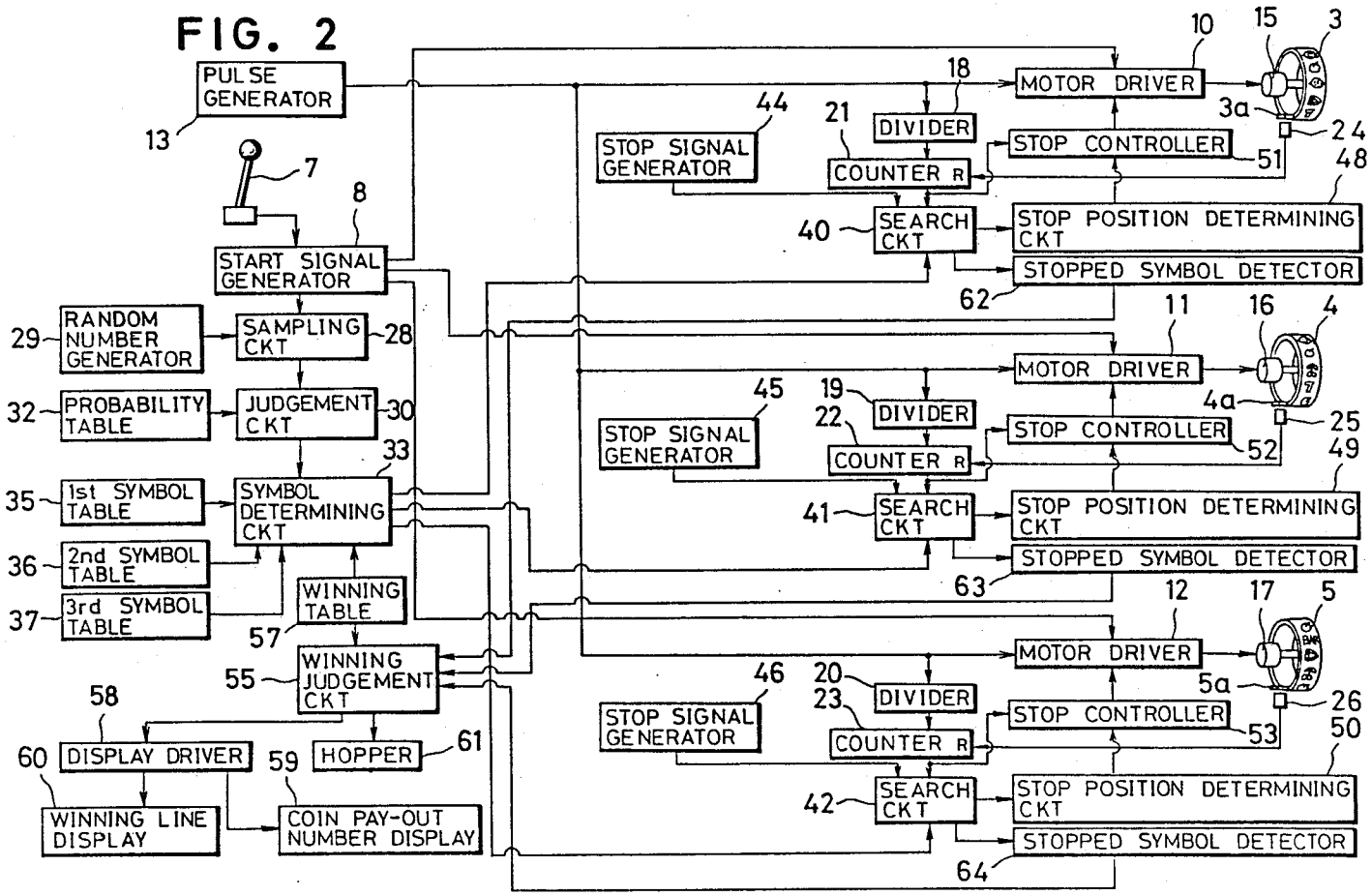
FIG. 2 is an electric circuit diagram of the slot machine of FIG. 1.

The game described above is played under the control of a system shown in FIG. 2. Upon pulling the start level 7, a start pulse is generated from the start signal generator 8 to activate motor drives 10 to 12 for the respective reels 3 to 5. The motor drives 10 to 12 thus activated allow a train of clock pulses from a pulse generator 13 to be supplied to stepping motors 15 to 17 so as to rotate the stepping motors 15 to 17 through a certain angle corresponding to the number of clock pulse supplied thereto, and thereby to correspondingly drive the reels 3 to 5.

Clock pulses to be supplied to the stepping motors 15 to 17 are supplied through dividers 18 to 20 to and counted by counters 21 to 23 respectively. As the number of clock pulses counted by each counter 21 to 23 changes depending on the rotated angle of each corresponding stepping motor 15, 16, 17, the angular positions of the stepping motors 15 to 17 can be precisely determined based on the counted values of the counters 21 to 23.

Each of the reels 3 to 5 is provided with, for example, 22 symbols of seven different kinds of symbols on its outer periphery at regular intervals and a datum lug 3*a*, 3*b*, 3*c* so disposed as to interrupt a photosensor 24, 25, 26 stationarily disposed in association with each of reels 3 to 5 once every revolution to provide a pulse which in turn is supplied to the respective counter 21 to 23, resetting its count to 0 (zero).

Since the number of symbols provided on each reel 3, 4, 5 and the number of pulses required for each reel to make one revolution are predetermined, the number of pulses required to rotate each reel 3, 4, 5 through a regular interval is precisely determined. Therefore, by adapting each divider 18, 19, 20 to frequency-divide a train of clock pulses to be supplied to each stepping motor 15, 16, 17 so as to deliver one pulse for the above-mentioned given number of pulses, and by arranging each datum lug 3*a*, 4*a*, 5*a* to interrupt the associated photosensor 24, 25, 26 to deliver a reset signal to the counter every time a predetermined reference symbol of each reel 3, 4, 5 reaches the winning line, the symbols which appear on the respective reels 3 to 5 on the winning line when the reels 3 to 5 stop can be found by reference to the counts of the counters 21 to 23.

Figure 3:
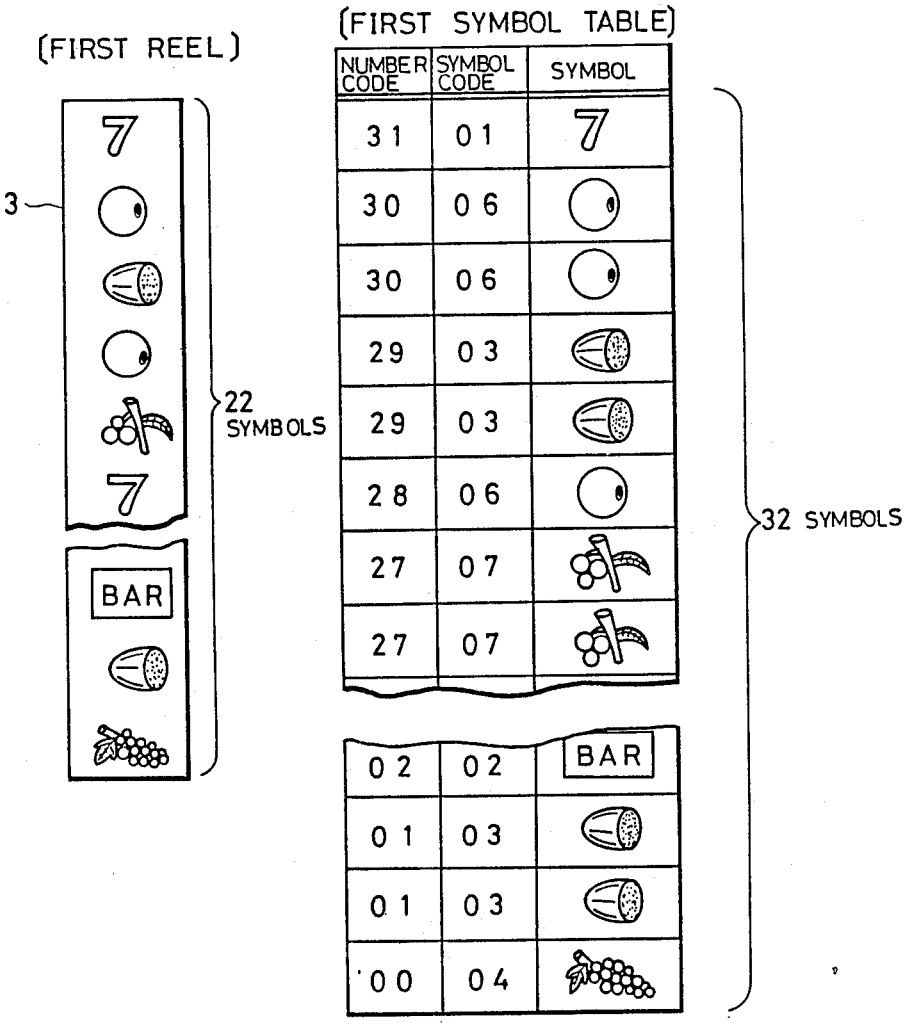
FIG. 3 conceptually shows a table in which the arrangement of symbols is contained.

In order to correlate the symbols appearing on the winning line with the counts of the counters 21 to 23, there are provided first to third symbol tables 35 to 37 one of which is shown schematically in FIG. 3. The symbol table in FIG. 3 which is associated with the first reel 3 includes data on the number codes and symbol codes. The number codes represent the positions of the individual symbols from the reference symbol and the symbol codes represent the kinds of symbols. It should be noted in FIG. 3 that the symbols shown in the first symbol table are shown only for a better understanding. In association with the second and third reels 4 and 5, there are second and third symbol tables 36 and 37 wherein data on the number codes and symbol codes are stored in accordance with the symbols on the respective reels 4 and 5. Each symbol table 35, 36, 37 can be provided by writing the number and symbol codes in sequence in a particular address area of a ROM.

As is apparent in FIG. 3, although there are actually 22 symbols provided on the periphery of the reel 3, nevertheless in the first symbol table 35 there is an arrangement of 32 symbols wherein some symbols have duplicates consecutively repeated and given the same number codes.

When pulling the start level 7, a start signal generator 8 generates a start signal which in turn is applied to a sampling circuit 28 so as to activate it to sample at random a random number Rs from a random series of numbers. The random number generator 29 wherein a 15-bit register is employed as a working area generates random numbers from 0 (zero) to 32,767 in the decimal system of notation in such a way that every random number is sampled only once every cycle.

A judgement circuit 30 refers the random number Rs thus sampled to the data of a probability table 32 and judges to which hit group of numbers the random number Rs belongs. The probability table 32 has the data of the three numerical values $R_1$, $R_2$ and $R_3$ by which all the random numbers are classified into four hit groups, namely, a big hit group, a middle hit group, a small hit group, and a failure group. Specifically, the values of $R_1$, $R_2$ and $R_3$ are predetermined according to the 32 symbols arranged in the respective symbol tables 35 to 37.

For example, if it is assumed that there are three, two, and one symbols possibly constituting big hit prize-winning combinations of symbols in the first, second and third symbol tables 35 to 37, respectively, the number of random numbers falling with the big hit group defined by the reference number $R_1$ is six, for example numerical numbers 0 (zero) to 5. In the same way, the number of random numbers falling within each hit group is predetermined according to the number of symbols on each reel which possibly constitute prize-winning combinations.

Figure 4:
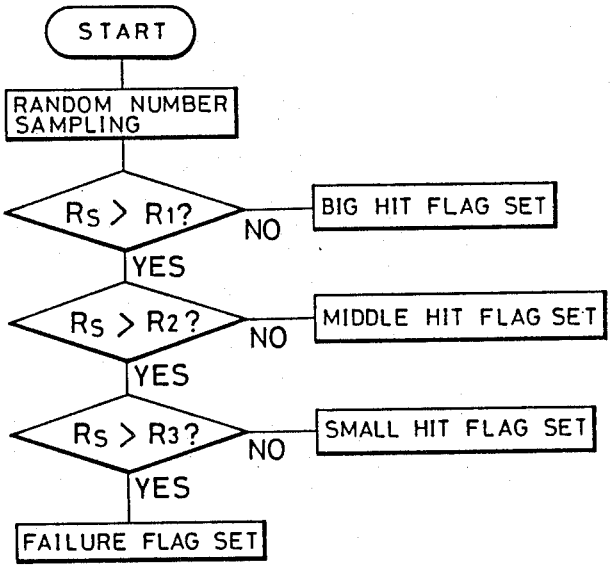
FIG. 4 is a flow chart illustrating the processing for detecting wins.

As is shown in FIG. 4, the judgement circuit 30 compares the value of the random number Rs with the reference numerical values $R_1$, $R_2$ and $R_3$ in sequence in this order, and sets therein a big hit flag if the value of the random number Rs falls within the range of 0 (zero) to $R_1$; a middle hit flag within the range of $R_1+1$ to $R_2$; a small hit flag within the range of $R_2+1$ to $R_3$; or a failure flat more than $R_3$. In the case of assuming the reference numerical values $R_1$, $R_2$ and $R_3$ to be 164, 1142, and 4420, respectively, then the probability is about 0.5% for the big hit, 1.05 for the middle hit, and 10% for the small hit.

When the medium hit flag is set up in the judgement circuit 30, a symbol-determining circuit 33 starts its operation to determine, with reference to a winning combination table, symbols of the first to third reels 3 to 5 to be caused to appear on the winning line which constitute one of the predetermined middle hit combinations of symbols. In the first to third symbol tables 35 to 37, the symbol arrangements on the first to third reels 3 to 5 are stored in the form of the combinations of number codes and symbol codes shown in FIG. 3. Therefore, by referring to the symbol codes, each symbol can be judged as to the hit group of prize-winning symbol combinations to which the symbol will belong. It is assumed in this embodiment that there are seven kinds of symbols provided on each reel 3, 4, 5 and two-digit consecutive code numbers, "01" to "07" are assigned thereto. Specifically, "01" and "02" are assigned respectively to "7" and the "BAR" symbol which belong to the big hit prize-winning symbol combinations;

and "03", "04", "05", and "06" are assigned respectively to pictures of "watermelon", "grape", "plum", and "orange", which latter belong to the middle hit prize-winning symbol combinations. "07" is assigned to the picture of a "cherry", which belongs to the small hit prize-winning symbol combinations.

As is described above, when the middle hit flag is set up in the judgement circuit 30, a symbol-determining circuit 33 determines the kind of symbol for the first reel 3. This determination can be performed by first repeatedly looking-up the data in the lower two bits of the first symbol table 35, namely, the symbol code K, in order of address, and then stopping the looking-up operation when the symbol code K is between "03" and "06" after an interval which is determined at random. Upon identification of the symbol, the symbol-determining circuit 33 refers to the data in the upper two bits of the first symbol table 35 so as to find a number code corresponding to the symbol code thus determined, and judges what displacement from the reference symbol the identified symbol has.

The same symbol-determining procedure as is described above as to the first reel is repeated with the aid of second and third symbol tables 36 and 37 as to the second and third reels 4 and 5. For example, if a middle hit prize-winning symbol combination is limited to the combination of three identical symbols such as the combination of three watermelon symbols, the symbol code of 03 is locked up after a randomly chosen interval so as to judge the positional place of the symbol code of 03.

If in fact the failure flag is set up in the judgement circuit 30, symbol-determining circuit 33 detects symbol codes in the symbol tables 35 to 37 which correspond to symbols which constitute any of a variety of possible prize-winning symbol combinations.

In the manner described above, symbols on the first to third reels 3 to 5 to appear on the winning line are identified with the aid of the judgment circuit 30, the probability table 32, the winning table 55, and the symbol-determining circuit 33 with its associated first to third symbol tables 35 to 37. Each symbol corresponds to a number code which determines the position of the symbol from the reference symbol on the respective reel. The number code of each symbol is then sent to and stored in the RAM memory of each search circuit 40, 41, 42.

While the symbol-identifying operation is being executed, the respective stepping motors 15 to 17 continue to rotate and the counters 21 to 23 count pulses supplied to the stepping motors 15 to 17 respectively. A stop signal is generated from each of three stop signal generators 44 to 46 at a random interval after the identification of the number code with the symbol-determining circuit 33 and supplied to each of the search circuits 40 to 42. Upon receiving the stop signal, each search circuit 40, 41, 42 compares the value of the number code stored in the RAM memory thereof with the counted value of each counter 21, 22, 23 associated therewith. When the two values coincide for the first time, each search circuit 40, 41, 42 transmits the counted value of each counter 21, 22, 23 to each of a plurality of stopped-position-determining circuits 48 to 50 and simultaneously causes it to provide a stop signal to each of a corresponding plurality of stop controllers 51 to 53. Upon the provision of the stop signal, each stop controller 51, 52, 53 causes each motor driver 10, 11, 12 to brake the associated stepping motor 15, 16, 17.

During the time each stepping motor 15, 16, 17 makes one revolution and is braked, the respective stop controller 51 to 53 compares counted values transmitted to the position-determining circuits 48 to 50 with the value now counted by the counters 21 to 23, respectively. At the moment the transmitted counted value and the now-counted value coincide, the stop controllers 51 to 53 cause the motor controllers 10 to 12 to stop the stepping motors 15 to 17. It is of course permissible to allow the stepping motors 15 to 17 to rotate more than one revolution until the stepping motors 15 to 17 are completely stopped after the braking thereof.

When the stepping motors 15 to 17 are stopped as a result of a properly executed operation, the reels 3 to 5 occupy positions according to the number codes specified by the symbol-determining circuit 33 so as to display on the winning line a combination of symbols on the respective reels 3 to 5 which is one of the hit combinations of symbols which the sampled random number Rs belongs to. Because of asynchronous rotation of each stepping motor 15, 16, 17, which occurs very rarely, the symbols specified based on the sampled random number Rs are not always displayed on the winning line. For this reason, there are stopped symbol detectors 52 to 53 and a winning judgment circuit 55 for judging whether in fact a combination of symbols previously determined has occurred. Each stopped symbol detector 52, 53, 54 is actuated at the time all the stepping motors 15 to 17 are stopped, to detect a symbol code of the symbol on the winning line with reference to the counted value of each counter 21, 22, 23. It is permissible to use the first to third symbol tables 35 to 37 in place of the counters. A combination of the symbol codes thus detected is transmitted to the winning judgment circuit 55 for judging whether the combination of symbols corresponding to the combination of the symbol codes is in fact a winning combinaiton. Thus judgment is effected by reference to a winning combination table 57 wherein data are stored including predetermined winning combinations of symbol codes and instructions as to operations to be performed following a judgment that a win has occurred. As a result of the win decision, there is a middle hit of a winning symbol combination on the winning line, the winning judgment circuit 55 causes a hopper 61 to pay out a number of coins corresponding to the middle dividend, for example, 15 coins, while actuating a display drive 58 so as to cause a coin pay-out number display 59 to show the number of coins to be paid out and a winning line display 61 to illuminate a line or lines on which winning combinations of symbols have occurred.

When there is a big hit by virtue of a winning symbol combination on a winning line that was played, the slot machine is operated according to a subroutine for allowing an extra bonus game after having paid out a high dividend, namely 15 coins. As is well known in the art, since the number of winning lines to be played depends on the number of playing coins inserted into the slot machine, the symbol-identifying circuit 33 determines the symbols on the reels 3 to 5 at each winning line that was played, and the winning judgment circuit 55 judges a combination of symbol codes as to each winning line.

As is described above in detail, the slot machine according to the present invention is adapted to sample, with a probability of 1/32,768, a random number Rs from a series of random numbers generated by the random number generator 29 comprising a 15-bit register and to refer the sampled random number Rs to the predetermined values of the probability table 32 so as to judge too which hit size the sampled random number Rs belongs. According to the hit size thus adjudged, a symbol combination corresponding to the hit size is determined with reference to the first to third symbol tables 35 to 37. Since there are 32 symbol codes in each symbol table 35, 36, 37 in spite of 22 symbols actually provided on each reel 3, 4, 5, one of a plurality of possible symbol combinations occurs on a winning line with a probability of $(1/32)^3$, and this is independent from the number of symbols on each reel. Moreover, every possible symbol combination can occur with the same probability as any one of the random numbers which is sampled.

It is permissible to predetermine three symbol codes to be combined according to a sampled random number Rs and then to detect each symbol code in the symbol table associated with each reel. In this case, since there are 32 symbol codes in each symbol table, the determination of a symbol combination can be made with the same probability as the sampling of a random number.

This invention is also applicable to a television-type slot machine which uses a CRT screen in lieu of a mechanical reel to display a series of movable symbols.

Although the present invention has been described with reference to preferred embodiments thereof, it is to be noted that various changes and modifications will be apparent to those skilled in the art. Therefore, unless otherwise such changes and modifications depart from the scope of the present invention, they should be construed as included therein.

What is claimed is:

1. A slot machine having X series of lengthwise movable symbols arranged side by side, and means to select a symbol from each said series of lengthwise movable symbols according to a random number sampled at random from a series of random numbers, there being $2^n$ random numbers in said series of random numbers, so as to provide a combination of X symbols on a line, n being a positive integer, a symbol table individual to each said series of lengthwise movable symbols, said table containing data of said symbols, said data being equal in number to the Xth root of $2^n$; and means for comparing said sampled random number to said data of said symbol table as to each of said X series of lengthwise movable symbols, thereby to identify a specific combination of X symbols corresponding to said sampled random number.

2. A slot machine as defined in claim 1, wherein n is 15 and X is 3.

* * * * *